US007677863B2

(12) United States Patent
Jansson

(10) Patent No.: US 7,677,863 B2
(45) Date of Patent: Mar. 16, 2010

(54) OVERSPEED SAFETY DEVICE FOR A ROTATION MOTOR

(75) Inventor: Anders Urban Jansson, Älvsjö (SE)

(73) Assignee: Atlas Copco Tools AB, Nacka (SE)

( * ) Notice: Subject to any disclaimer, the term of this patent is extended or adjusted under 35 U.S.C. 154(b) by 644 days.

(21) Appl. No.: 11/579,218

(22) PCT Filed: Apr. 29, 2005

(86) PCT No.: PCT/SE2005/000632

§ 371 (c)(1),
(2), (4) Date: Apr. 10, 2007

(87) PCT Pub. No.: WO2005/105370

PCT Pub. Date: Nov. 10, 2005

(65) Prior Publication Data

US 2008/0025836 A1 Jan. 31, 2008

(30) Foreign Application Priority Data

Apr. 30, 2004 (SE) ..... 0401119

(51) Int. Cl.
*F01B 25/00* (2006.01)

(52) U.S. Cl. ..... 415/25; 415/41; 415/42; 415/904

(58) Field of Classification Search ..... 415/21, 415/25, 30, 36, 41, 43, 202, 904
See application file for complete search history.

(56) References Cited

U.S. PATENT DOCUMENTS 3,767,332 A * 10/1973 Wickham et al. ..... 418/43
3,923,429 A * 12/1975 Schaedler et al. ..... 418/43
4,265,604 A 5/1981 Dreher et al.
5,297,573 A 3/1994 Jacobsson
2004/0086374 A1* 5/2004 Elsmark et al. ..... 415/25

FOREIGN PATENT DOCUMENTS

EP 5077576 A1 1/1994

* cited by examiner

*Primary Examiner*—Igor Kershteyn
(74) *Attorney, Agent, or Firm*—Frishauf, Holtz, Goodman & Chick, P.C.

(57) ABSTRACT

An over-speed safety device for a pneumatic rotation motor having a cylinder (10), a forward end wall (11), a rear end wall (12) with a pressure air inlet opening (21), a rotor (13), and an actuator (15) co-rotative with the rotor (13) and responsive to centrifugal action, and a valve lid (20) tiltable relative to a pivot axis (C) and shiftable between an open position and a closed position for controlling the airflow though the inlet opening (21), wherein the pivot axis (C) extends along a chord in relation to the rotor centre, and the actuator (18) comprises a cam surface (25) for camming engagement with the valve lid (20) for moving the latter in a radial direction toward the closed position. The valve lid (20) is supported by ridge positions (33, 34) on a seat surface (2) disposed around the inlet opening (21), and a wire spring (26) is arranged to retain and bias the valve lid (20) against the seat surface (32). The ridge portions (33, 34) are arranged to make the valve lid (20) perform an over-centre movement when shifted from open to closed position, thereby obtaining a bi-stable action of the valve lid (20) under action of the wire spring (26).

3 Claims, 5 Drawing Sheets

OVERSPEED SAFETY DEVICE FOR A ROTATION MOTOR

Figure 1:
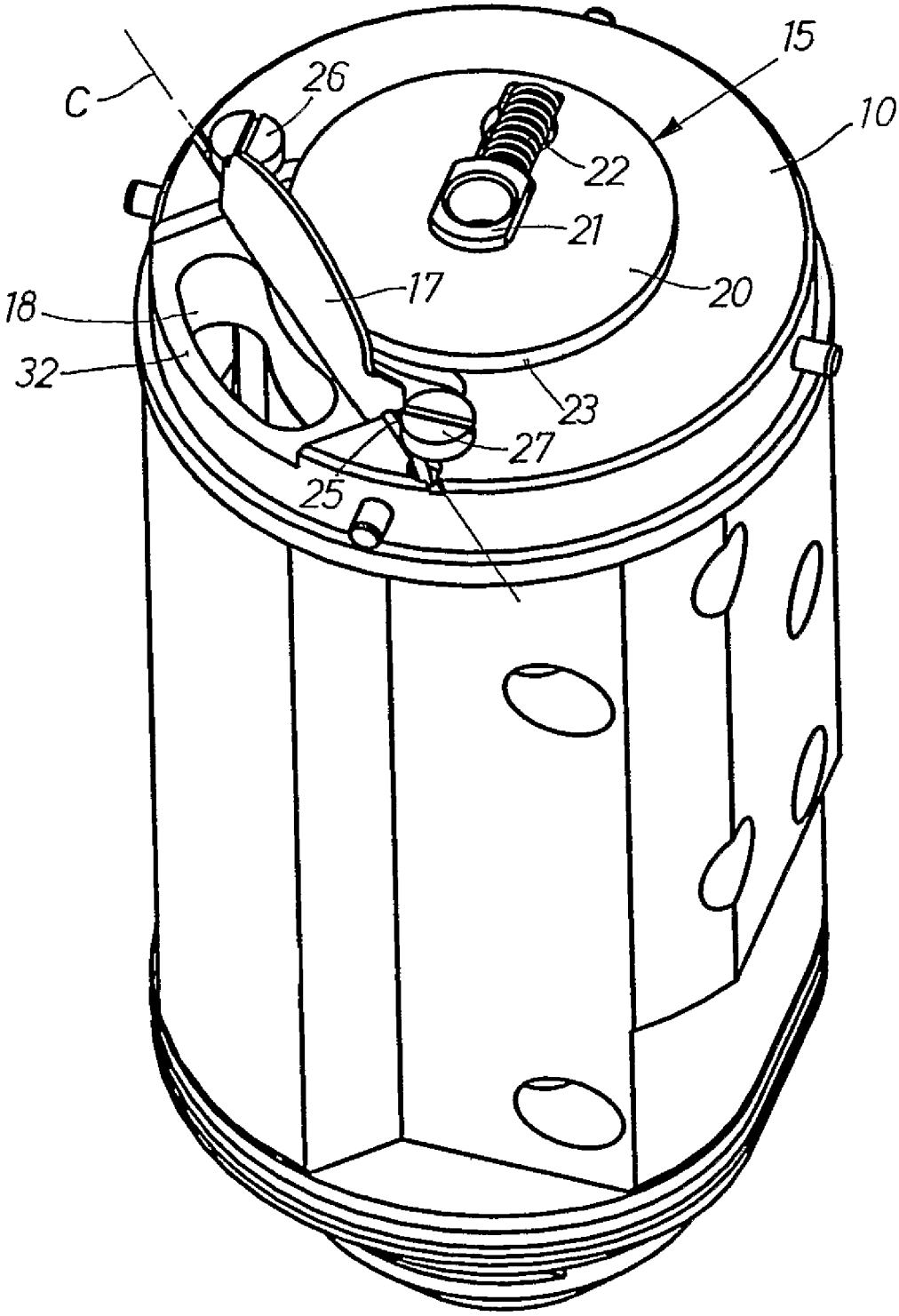

This application is a U.S. National Phase Application under 35 USC 371 of International Application PCT/SE2005/000632 filed Apr. 29, 2005.

The invention relates to an overspeed preventing safety device for a pneumatic rotation motor having a housing with a pressure air inlet passage, and a rotor, wherein the safety device comprises an actuator co-rotative with the rotor and responsive to centrifugal action, and a valve element supported in the housing for controlling the air flow through the inlet passage and shiftable by the actuator from an open position to a closed position as the rotor speed exceeds a predetermined maximum speed level.

There are a number of problems concerned with creating a good overspeed preventing device for a pneumatic rotation motor. An overspeed safety device has to be hundred percent reliable, i.e. it must not get inoperable due to dirt, corrosion etc. or otherwise during a long time of motor operation. Since overspeed safety devices are always fitted to rotation motors having speed governors they will only release in case of malfunction of the speed governor. This means that, hopefully, it will take quite some period of time before the speed governor stops working properly and the safety device has to get into operation. During that period the overspeed safety device must continuously be in an operable stand by condition ready to immediately prevent overspeed should the governor start malfunctioning.

Moreover, an overspeed safety device should preferably be compact and simple in design not to add to the over all dimensions of the motor. The safety device should not be possible to activate unintentionally, for instance via blows or other external influence on the motor housing. Preferably, the overspeed safety device should not be self-destructive when activated, but be able to be reset and to be used again. If the safety device has a non-destructive release action it could be activated and checked as regard activation speed level-before delivery from the factory and reset. Manufacturing tolerances of the different parts inevitably cause a scattering of the activation speed levels of the devices after assembly, and by being able to make a non-destructive functional test of the device before delivery it would be possible to increase safety by ruling out devices having an activation speed outside the accepted tolerances.

In U.S. Pat. No. 4,265,604 there is described a pneumatic power tool provided with an overspeed safety device which comprises a pin shaped actuator co-rotative with the motor rotor, and a valve element arranged to be hit and tilted by the actuator from an open position to a closed position. This device suffers from at least one serious drawback, namely that the actuator pin will hit the valve element at a very high speed and most probably tear the said edge of the latter before accomplishing any movement thereof. When the valve element is hit hard enough to be moved toward its closed position there is an obvious risk that the blow delivered by the actuator pin would slam the valve element against the seat surface so violently that the valve element would either break apart or just bounce back towards open position. This problem is due to the fact that the actuator pin hits the valve element in the tangential direction at a very high speed, namely the peripheral velocity of the actuator. Most probably, this device would not be possible to test before delivery as regard function and thereafter be reset in a still perfect condition.

In U.S. Pat. No. 5,297,573 there is described a pneumatic power tool with an over speed safety device wherein the actuator comprises a rotating ring shaped disc which is arranged engage an activation rod by a part circular peripheral outer surface, which means that the rotation movement of the actuator is transferred to the activation rod a via camming action. This means that the activation rod is not exposed to any violent hits by the actuator at overspeed but is pushed in in a more gentle way. However, this known device is rather complicated and bulky and demands a very special type of motor housing.

The main object of the invention is to create an overspeed safety device for a pneumatic motor which is not only simple and compact in design but which comprises an actuator/valve element arrangement which is non-destructive at release and which is possible to be tested as regard function and to be reset before delivery with a maintained highly reliable function.

Further objects and advantages with the invention will appear from the following specification and claims. A preferred embodiment of the invention is below described in detail with reference to the accompanying drawings.

IN THE DRAWINGS

FIG. 1 shows a perspective view of an overspeed safety device according to the invention.

Figure 2A:
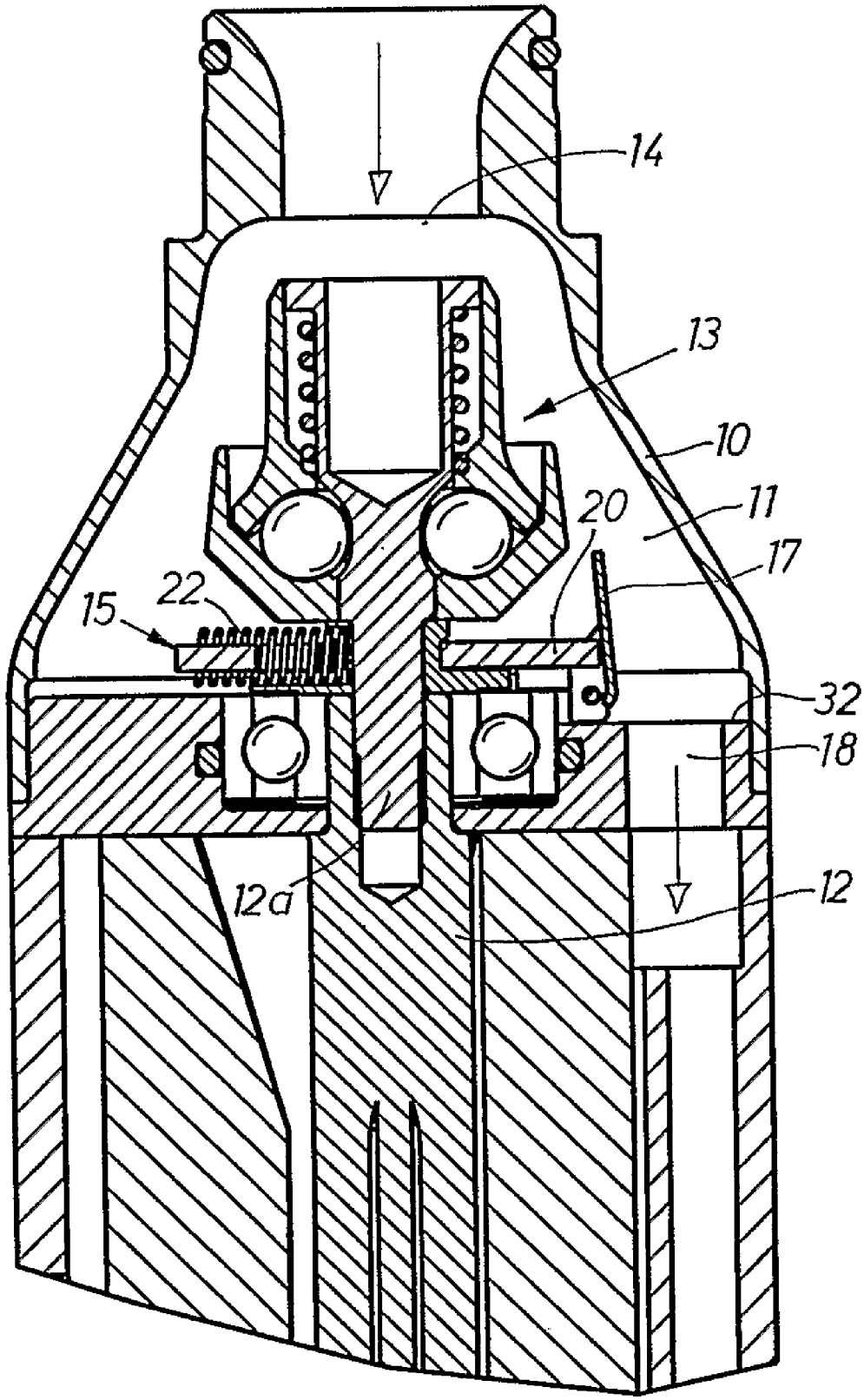

FIG. 2*a* shows a longitudinal section through the device in FIG. 1 and illustrating the normal open position of the device.

Figure 2B:
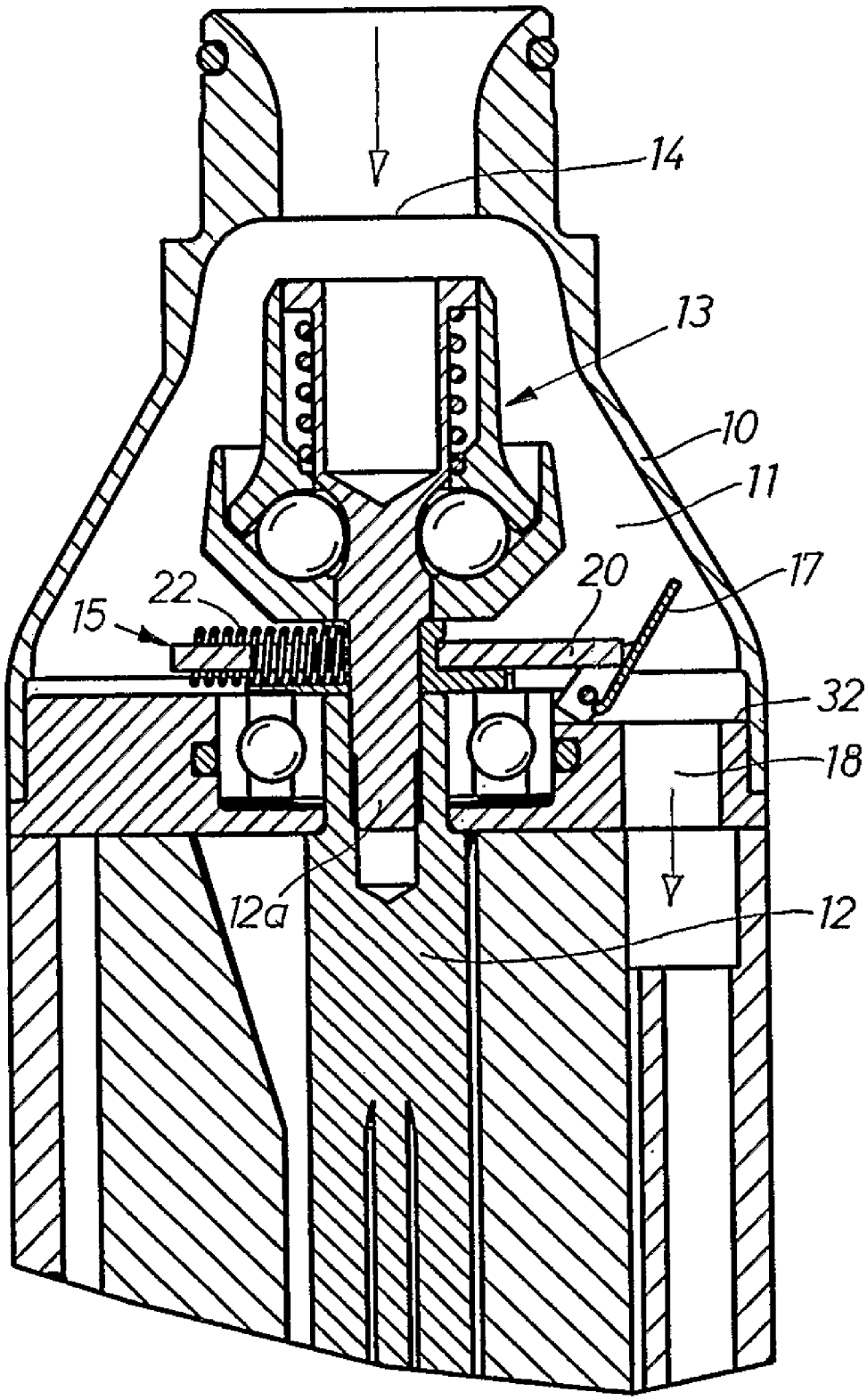

FIG. 2*b* shows the same section as in FIG. 2*a* but illustrates the device in an activated but not yet closed position.

Figure 2C:
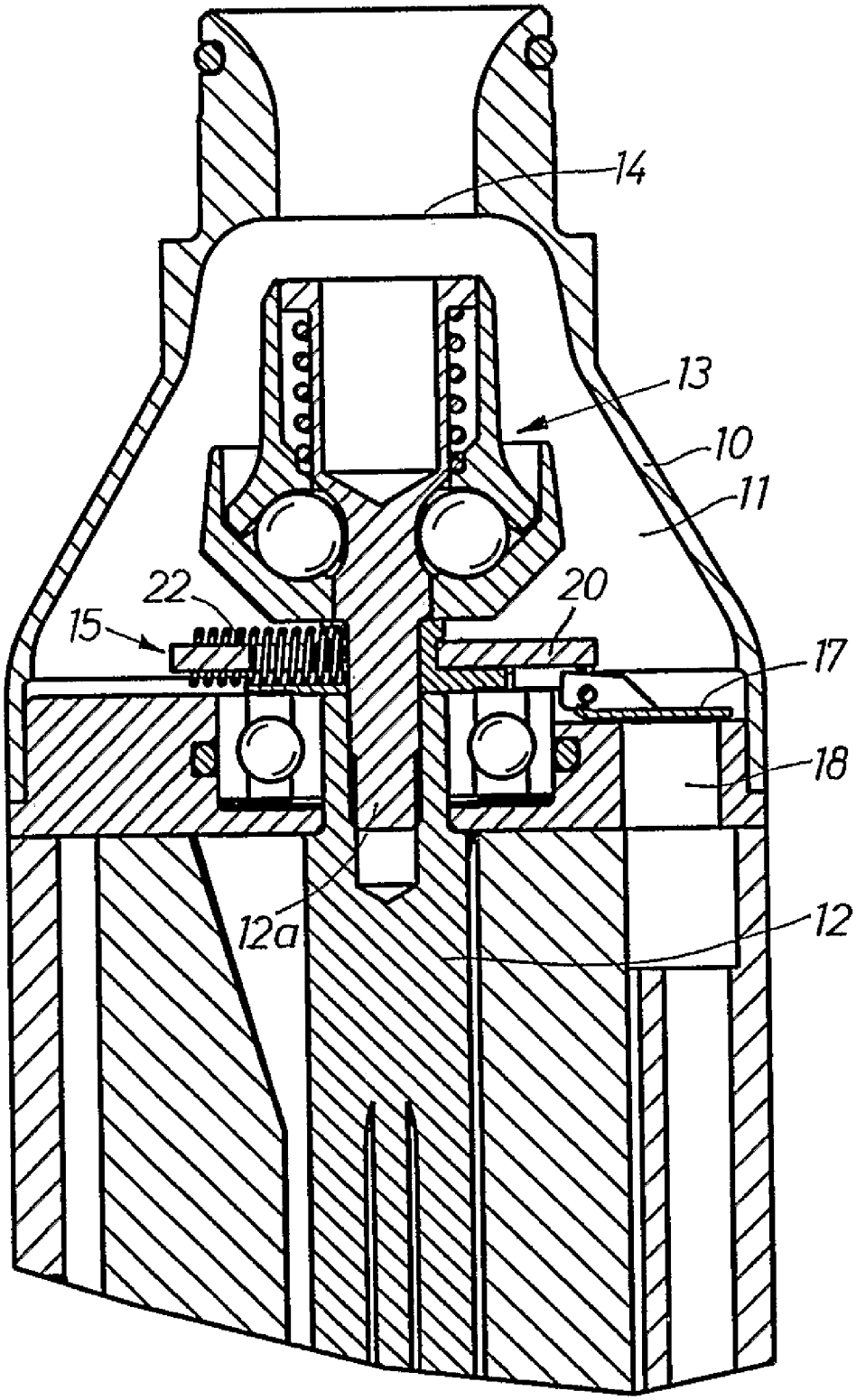

FIG. 2*c* shows the same section as in FIG. 2*a* but illustrates the closed position of the device.

Figure 3:
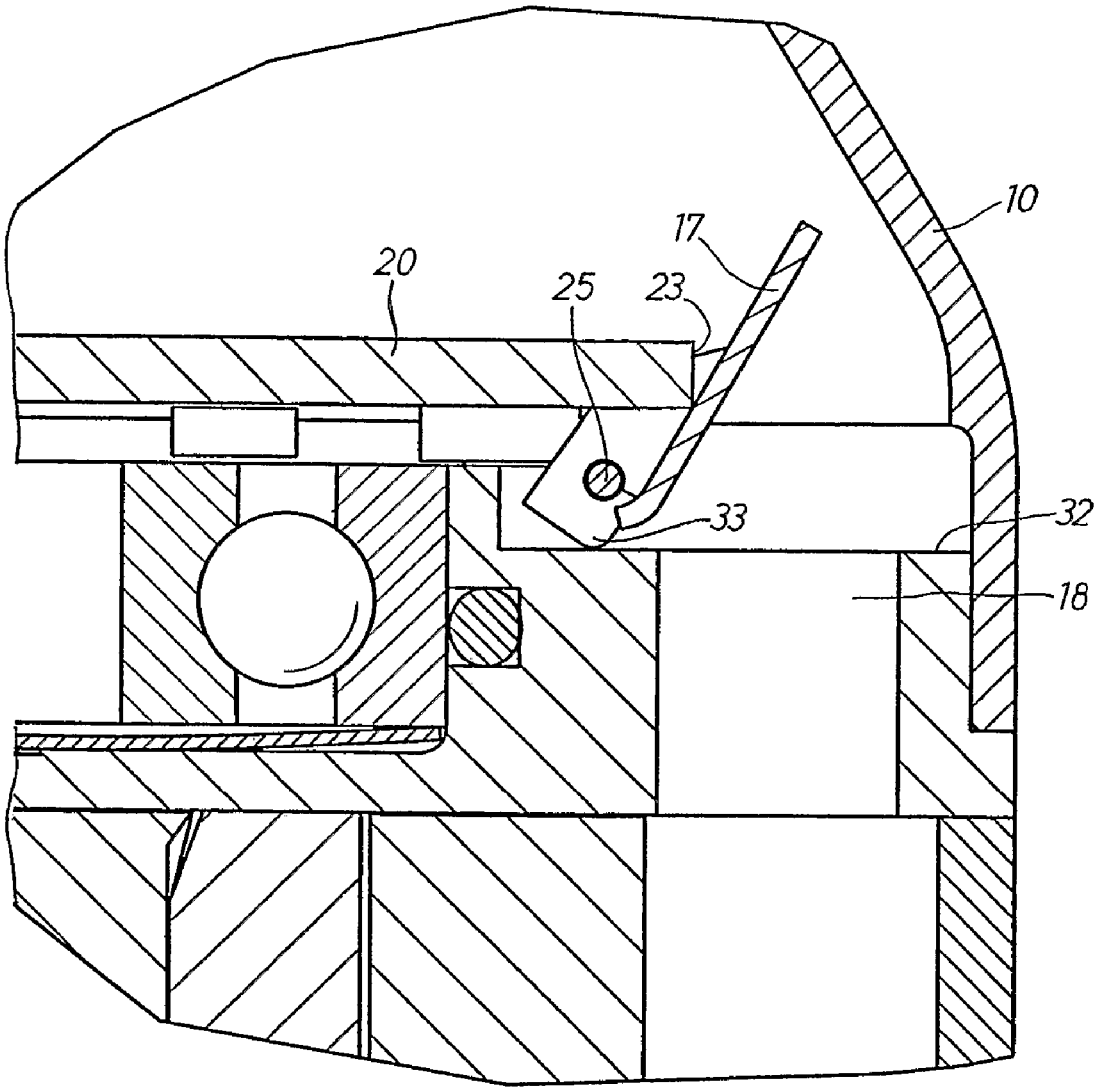

FIG. 3 shows, on a larger scale, the device in FIGS. 1 and 2.

The overspeed safety device illustrated in the drawings is applied on a pneumatic vane motor comprising a cylinder 10, a forward end wall 11, a rear end wall 12, a rotor 13 rotatively journalled in the end walls 11,12, and a pressure air inlet funnel 14 connected to the rear end wall 12. The inlet funnel 14 forms an air inlet passage 15 and has a supply opening 16 at its rear end. The opening 16 is controlled by a speed governor 17 of a conventional ball activated type connected to the rotor 13 via a spindle 19. The speed governor 17, which is not described in further detail, is intended to keep the motor operating at a predetermined speed level at varying loads by controlling the pressure air supply to the motor via the supply opening 16.

The overspeeed safety device comprises an actuator 18 which is supported on the governor spindle 19 connected to and co-rotating with the rotor 13. The overspeed safety device also includes a movable lid 20 which forms a valve element which is supported on the rear end wall 12 of the motor. The lid 20 is arranged to be shifted by the actuator 18 from an open position to a closed position as the motor speed exceeds the predetermined speed level normally provided by the speed governor 17. In its closed position the lid 20 is arranged to block the pressure air flow through an inlet opening 21 in the rear end wall 12.

The actuator 18 is supported on the governor spindle 19 and comprises a circular disc 22 which is provided with a radially extending aperture 23 through which the spindle 19 extends. In the aperture 23 there is mounted a coil spring 24 for biasing the disc 22 into a normal concentric position relative to the spindle 19. Since the disc 22 has a centre of gravity located offset from the geometric centre of the disc 22 the latter is apt to leave its concentric position at high speed rotation. At a certain speed level the centrifugal action on the disc 22 will dominate over the bias force of the spring 24 whereby the disc 22 will move radially. The outer periphery of the disc 22 forms a cam surface 25, and when the disc 22 leaves its concentric position the cam surface 25 will get into contact with the lid 20 and displace the latter in a radial direction, thereby initiating a closing movement on the lid 20.

The lid 20 is tiltable about a pivot axis C which forms a chord in relation to the rotation axis of the rotor 13. The tilting movement of the lid 20 is retained by a substantially straight wire spring 26 the ends of which are received in grooves 29,30 in the rear end wall 12 and secured to the rear end wall 12 by two screws 27,28. The rear end wall 12 is formed with a flat seat surface 32 surrounding the inlet opening 21, and in its closed position the lid 20 is arranged to cover the inlet opening 21 and engage the seat surface 32.

At its ends, the lid 20 is formed with a ridge portions 33,34 which serve to define the open and closed positions of the lid 20. See FIG. 3. In the open position of the lid 20 the ridge portions 33,34 make the wire spring 26 act in the opening direction of the lid 20, and when moved in its closing direction the lid 20 performs an over-centre movement in which the ridge portions 33,34 lift the lid 20 against the action of the wire spring 26. Having passed the top centre of the ridge portions 33,34 the spring 26 acts to move the lid 20 in the closing direction. By this over-centre movement accomplished by the ridge portions 33,34 the lid 20 gets a bi-stable action, which means that the lid 20 is safely maintained in its open position during normal motor operation and distinctly moved to its closed position when activated by the actuator 18. When activated the lid 20 is urged into its closed position also by the pressure drop in the air flow through the inlet opening 21, but due to the spring/ridge portion arrangement the lid 20 is maintained in its closed position also after the pressure air supply to the motor has been discontinued and no pressure drop acts on the lid 20.

The overspeed safety valve according to the invention is advantageous in that the valve lid 20 is movable in the radial direction and that the actuator 18 comprises a cam surface 25 for engaging and shifting the lid 20 by a relatively gentle force. This means that the lid 20 is not exposed to any detrimental impact forces at activation of the device and may very well be reset and used again, with a maintained proper function and reliability.

The invention claimed is:

1. Overspeed safety device for a pneumatic rotation motor including a cylinder (10), a pressure air inlet opening (21), and a rotor (13), comprising an actuator (18) co-rotating with the rotor (13) and responsive to centrifugal action, and a valve element (20) arranged to control the air flow through the inlet opening (21), said valve element (20) is arranged to be engaged by the actuator (18) for initiating a shifting movement of the valve element (20) from an open position to closed position as the rotor speed exceeds a predetermined maximum speed level, said valve element (20) is formed by a lid which is tiltable about a pivot axis (C) between the open position and the closed position, and said pivot axis (C) extends substantially along a chord related to the centre of the rotor (13), and the actuator (18) is formed with a cam surface (25) for caming engagement with said lid (20) for accomplishing tilting of said lid (20) about said pivot axis (C), wherein said inlet opening (21) is surrounded by a flat seat surface (32) for sealing engagement by the lid (20) in the closed position of the latter, said lid (20) is formed with at least one ridge portion (33,34) for resting on said seat surface (32), a spring (26) is arranged to retain and bias said lid (20) toward said seat surface (32) such that when shifted between the open position and the closed position the lid (20) is made to perform a bi-stable over-centre movement by the ridge portion or portions.

2. Device according to claim 1, wherein the motor comprises a forward end wall (11) and a rear end wall (12), and the pressure air inlet opening (21) as well as said lid (20) are located to the rear end wall (12).

3. Device according to claim 2, wherein said spring (26) comprises a substantially straight wire spring which at its ends is secured to the rear end wall (12) and tiltably supports the lid (20).

* * * * *